United States Patent [19]

Brackmann et al.

[11] 4,349,037

[45] Sep. 14, 1982

[54] TOBACCO MOISTENING AND OPENING APPARATUS

[75] Inventors: Warren A. Brackmann, Cooksville; Stanislav M. Snaidr, Mississauga, both of Canada

[73] Assignee: Rothmans of Pall Mall Canada Limited, Don Mills, Canada

[21] Appl. No.: 272,515

[22] Filed: Jun. 11, 1981

Related U.S. Application Data

[62] Division of Ser. No. 126,547, Mar. 3, 1980, Pat. No. 4,307,736.

[30] Foreign Application Priority Data

Mar. 5, 1979 [GB] United Kingdom ..... 7907714

[51] Int. Cl.[3] ..... A24B 3/12

[52] U.S. Cl. ..... 131/306

[58] Field of Search ..... 131/300, 302, 303, 304, 131/306, 307

[56] References Cited

U.S. PATENT DOCUMENTS 3,357,437 12/1967 Maguire ..... 131/136

*Primary Examiner*—V. Millin

*Attorney, Agent, or Firm*—Sim & McBurney

[57] ABSTRACT

A steaming doffer for use in the moistening and opening of tobacco from bales is described. The device includes a plurality of pairs of arms fixedly mounted to a rotatable axle. Each arm member pair is angularly offset from each adjacent pair so that the outer extremities of the arm members lie on helices. A plurality of axially-directed steam-jet forming openings are provided at the outer extremity of each arm member and communicate with an external source of steam through a bore in the axle member which feeds a bore in each arm member.

1 Claim, 6 Drawing Figures

TOBACCO MOISTENING AND OPENING APPARATUS

This is a division of application Ser. No. 126,547 filed Mar. 3, 1980 now U.S. Pat. No. 4,307,736.

The present invention relates to the moistening and opening of tobacco from bales and hogsheads.

In our copending U.S. patent application Ser. No. 951,655 now U.S. Pat. No. 4,222,397, there is described a procedure wherein bales of tobacco are moistened and opened by impinging steam onto one end face of a tobacco bale to cause penetration of steam into the face and removing tobacco from the moistened face. The bale is located on a horizontal surface with the grain of the tobacco layers extending vertically and from one end face to the other.

Tobacco is removed from the one end face of the bale and steam is impinged into that face by rotating doffer elements which have helically-oriented hollow arms to which steam is fed and from which steam is ejected through a plurality of openings therein. The latter structure is effective in moistening and opening the tobacco but is difficult to construct and expensive to replace.

The present invention is concerned with an improved steaming doffer structure which enables the prior art difficulties to be overcome while maintaining an effective tobacco moistening and opening operation.

The steaming doffers of this invention have an elongate axle member which can be mounted for rotation. The axle member has an elongate core extending the length thereof for communication with a source of steam. A plurality of pairs of arm members are mounted to the axle member. The members of each pair extend in diametrically opposite directions radially of the axle member. Each pair of arm members is angularly offset from each adjacent pair, so that the outer radial extremities of the arm members define two helices relative to the axle member. Each arm member has a bore extending the length thereof which communicates at the axle or inboard end with the elongate bore in the axle member. The bore in the arm member communicates at the radially outer or outboard end with a plurality of radially directed openings, so that a plurality of steam jets may be ejected at the outboard end of each arm member.

The multicomponent structure of the steaming doffer of this invention permits easy fabrication of the component parts and easy assembly of the steaming doffer, in contrast to the prior art. Individual arms are easily replaced, if damaged, and wear blocks may be provided at the outer extremities of the arms may be replaced, when required. This contrasts markedly with the prior art structure, discussed above, wherein replacement of the whole doffer unit is required if one of the helical arms becomes damaged or worn.

The invention is described further, by way of illustration, with reference to the accompanying drawings, in which.

Figure 1:
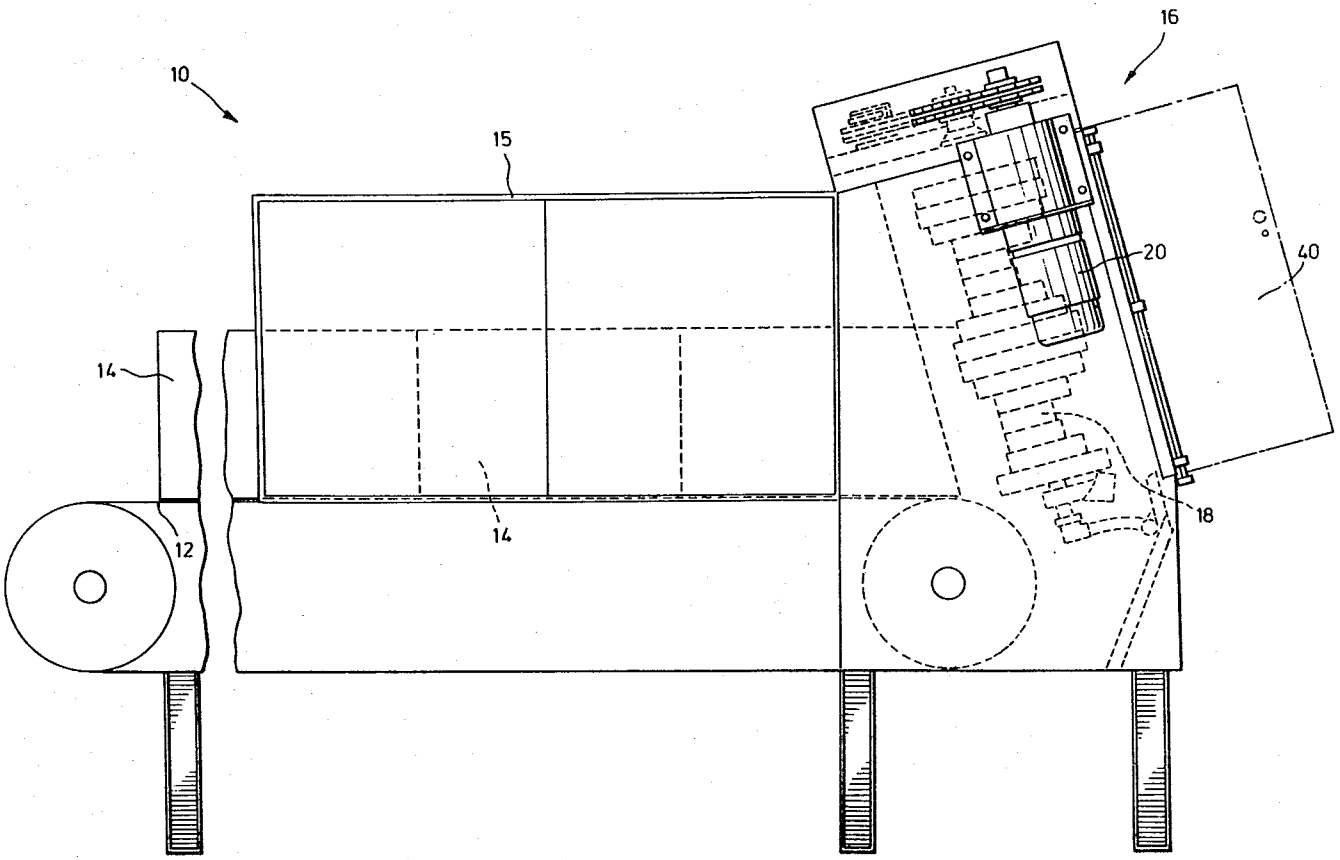
FIG. 1 is a side elevational view of a tobacco moistening and opening apparatus incorporating one embodiment of this invention.

Referring to the drawings, an apparatus 10 for continuously premoistening and opening of compressed tobacco bales includes an endless conveyor belt 12 on which are received tobacco bales 14. The term "tobacco bale" is generally considered to refer to rectangularly cross-sectioned cuboid compressed tobacco blocks in which the dry tobacco leaves are layered so that there is a distinct "grain" extending from one end face to the other. The bales 14 have this grain extending vertically.

The present invention and that of our prior application is not restricted to the opening and moistening of tobacco from such bales, but includes the opening and moistening of tobacco from any shaped compressed tobacco bundle, and the term "bale" as used herein is intended in that sense. Other such bales include tobacco hogsheads, i.e., cylinders of compressed tobacco leaves in which the grain extends transverse to the axis of the cylinder.

When such hogsheads are treated in accordance with the procedure of this invention and our prior application, they are placed on their side on the conveyor 12 with their axis transverse thereto, so that the grain again extends substantially vertically.

The vertical orientation of the grain in the bales 14 is important to the moistening and opening procedure. Opening efficiency is considerably diminished if the grain is located horizontally or if the bale is oriented with the grain extending from side to side.

The conveyor belt 12 extends through a tunnel 15 to a tobacco moistening and opening apparatus 16 wherein is housed a plurality of laterally-spaced conditioning and opening doffer elements 18. Each of the doffer elements 18 is mounted for rotation about its vertical axis.

Figure 2:
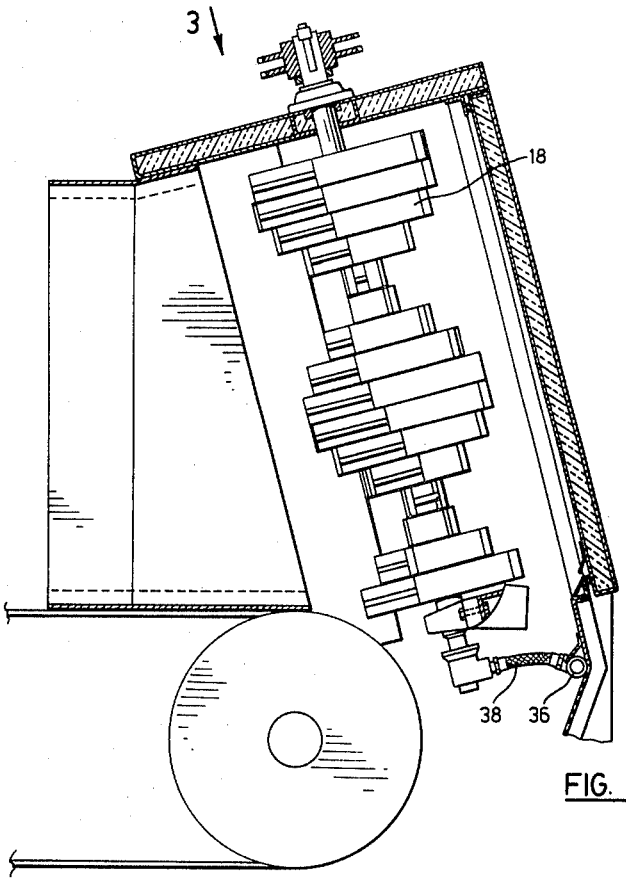
FIG. 2 is a sectional close up view of a portion of the apparatus of FIG. 1 illustrating a steaming doffer provided in accordance with this invention.

In the illustrated embodiment, the doffer elements 18 are inclined to the vertical inwardly towards the tobacco bale 14 when viewed in side elevation (see FIGS. 1 and 2) while the axes are planarly aligned when viewed in side elevation, so that the leading face of the bale 14 assumes an inclined form. The surge of incompletely conditioned tobacco which may result from bale end collapse when an upright orientation is employed, is eliminated by this arrangement.

Four doffer elements 18 are illustrated and this number is chosen for convenience. Any desired number may be chosen depending on the individual size of the doffer elements 18 and the dimension of the bales 14 to be processed.

Figure 3:
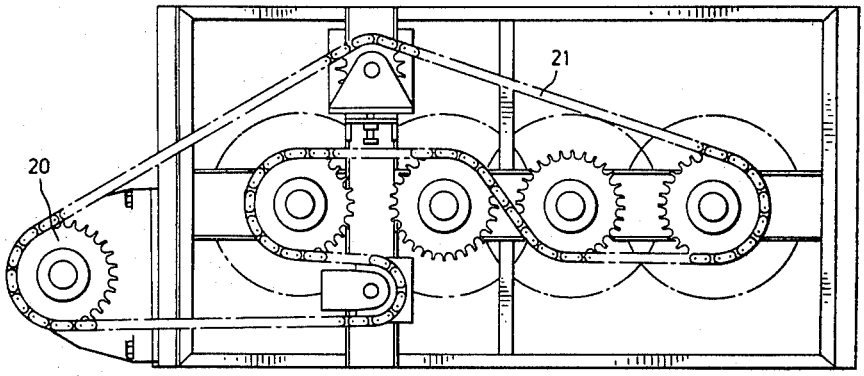
FIG. 3 is a plan view from above of the doffers of FIG. 2 taken in the direction of the arrow.

The doffer elements 18 are driven by a single drive motor 20 through suitable gearing and chains 21, as shown in FIG. 3, to permit the left hand pair of doffer elements 18 to rotate anti-clockwise and the right hand pair to rotate clockwise. The doffer elements 18 are driven in this way to provide an efficient opening motion with respect to the tobacco. Other rotation direction combinations may be employed.

As seen in detail in FIGS. 2 and 4 to 6, each doffer element 18 comprises a hollow axle member 22 having a steam flow passage 23 longitudinally extending therein and a plurality of pairs of radially-directed diametrical arms 24 clampingly mounted to the axle 22 such as, by bolts 25. To assist in preventing rotation of the arms 24 relative to the axle 22, mating flat surfaces may be provided on the axle 22 and the arms 24, as illustrated.

Each pair of arms 24 is angularly offset from the immediately-adjacent pairs in regular manner, so that the radial extremities of the arms define two generally helical outlines with respect to the axle 22.

Figure 4:
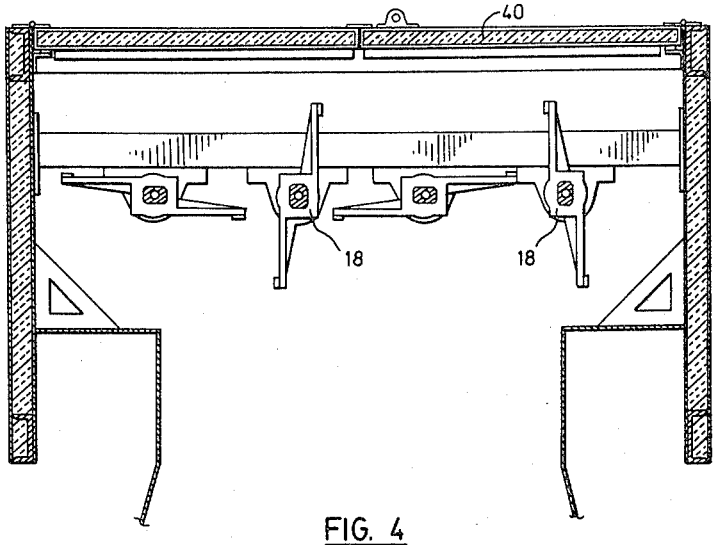
FIG. 4 is a plan view showing relative location at tobacco engaging elements of the steaming doffers.
Figure 5:
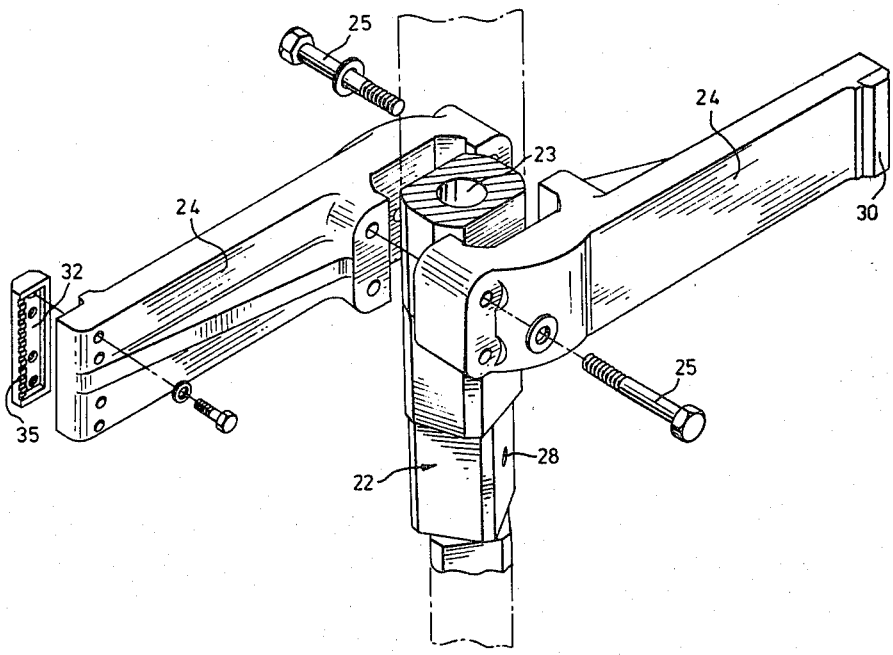
FIG. 5 is an exploded perspective view of the assembly of the tobacco engaging elements of the steaming doffers with the axle thereof.
Figure 6:
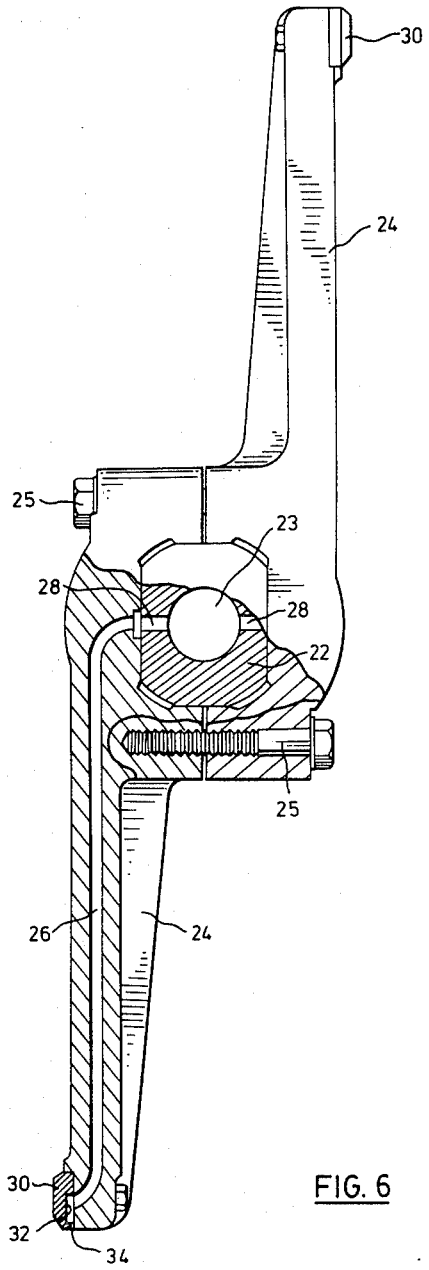
FIG. 6 is a part-sectional plan view of assembled tobacco engaging elements.

The steaming doffers 18 are mounted adjacent to each other in the apparatus 16 so that, in the same horizontal plane, the pairs of arms 24 are offset about 90° from those in the immediately adjacent doffers, as illustrated in FIG. 4. The resulting interdigitation of arms 24 assists preventing hang-up of opened tobacco leaves between vertically-adjacent angularly offset arms 24, by reason of the wiping action of adjacent arms 24 of adjacent doffers 18.

Each arm 24 has a steam flow passage 26 formed therein extending longitudinally thereof and communicating at one end with the steam flow passage 23 of the axle 22 by radially-directed passages 28 formed in the axle 22. The arms 24 may be formed by casting with the steam flow passage 26 being constituted by an elongate tube positioned in the mold during casting. Any other convenient forming technique may be used.

At the radial extremity of the arm 24 is releasably mounted a wear block 30 which engages the tobacco bale 14 during moistening and opening operations. The wear block 30 has a recess 32 formed therein and a plurality of closely spaced radial passages 34 communicating therewith. The radial passages 34 are constituted by grooves 35 machined or otherwise formed in the surface of the block 30 intended to abut the adjacent face of arm 24. The cross-sectional size of the passages 34 is easily controlled in this invention and may be made smaller or larger, as required, by suitable machining of the block 30. The radial passages 34 permit steam passing from the passage 23 along the arm 24 by passage 26 to the header provided by the recess 32 to be projected therefrom as jets.

A steam manifold line 36 is provided from which individual steam lines 38 extend to the individual doffer elements 18. Steam fed to the apparatus 10 engages the front end face of the tobacco bale 12 by impingement from passages 34.

The passages 34 are positioned with respect to the contact point of the arm 24 with the front face of the tobacco bale 12 so that the steam jet impingement is a direct injection of steam into the bale face, resulting from engagement between the openings of the passages 34 and the tobacco bale face.

An openable door 40 encloses the downstream side of the apparatus 10, enabling access to be had to the rotating doffers 18 for servicing or the like, when desired.

In operation, a bale 12 of tobacco is continuously moved forward by the conveyor 14 against the rotating doffer elements 18 from which steam jets project through the passages 34. As each individual wear block 30 engages the tobacco bale 12, steam jets impinge upon and enter the surface substantially perpendicularly thereto. At the same time, the transverse wiping action of the arms 24 removes tobacco from the bale surface.

By injecting steam into the front face of the tobacco, the steam is able to penetrate between the vertically-oriented bale lamina and moisten the tobacco sufficiently that the doffer opening action does not significantly degrade the tobacco.

The penetration achieved by the steam is several times greater than the depth of tobacco removed from the front face of the bale 12 by each engagement of the arms 24 of the doffer element 18.

The apparatus illustrated in the drawings thus operates in a manner substantially identical to that of our prior applications, and hence shares the benefits thereof. However, the structure of the doffers 18 used in this invention is quite different from the doffer structure described in the prior application and has substantial advantages in comparison therewith. The use of a plurality of offset pairs of arms 24 in the doffers 18 of this invention permits easy fabrication and assembly of the component parts, in contrast to the one piece welded helical structure of the prior application.

The arms 24 are easily formed, such as, by casting, and individual ones may be readily replaced, if damaged. After long use, the wear blocks 30 only need be replaced. In contrast, in the prior structure the whole doffer unit requires replacing if it becomes damaged or worn.

The steam jet openings 34 are readily formed by simple machining of the surface of the wear block 30 to form the grooves 35 in this invention, whereas a multiple number of individual tube drillings are necessary to provide steam jet openings in the prior art unit. Additionally, the size of the steam jet openings 36 may be readily altered in this invention, whereas in the prior structure, while the opening size can be enlarged, it is not possible to diminish the size.

The present invention, therefore, provides an improved steaming doffer structure, a tobacco or other material moistening and opening assembly using such improved doffers and a tobacco or other material moistening and opening procedure using such improved doffers. Modifications are possible within the scope of the invention.

What we claim is:

1. In a continuous method for the conditioning of tobacco in bales, which comprises continuously feeding a succession of tobacco bales horizontally with the grain in each bale oriented substantially vertically and with the grain extending from a forward face to a rear face of the bale, continuously subjecting the forward face of the succession of bales of the impingement of a plurality of steam jets to cause penetration of steam into the forward face and moistening of tobacco therein, and continuously removing the moistened tobacco from said forward face by the application of tobacco removal forces generally transverse to the leading face and generally perpendicular to the bale grain substantially simultaneously with said steam jet impingement, said steam penetration into said forward face exceeding the depth of tobacco removed therefrom by said transverse forces, the improvement wherein said plurality of steam jets are arranged in groups of two generally-helically directed sets with reference to and on opposite sides of a vertical axis, the vertical axes of the groups being parallel to each other and spaced from each other across the forward face of the bale, the steam jets in each helical set are arranged in individual pluralities, the members of each individual plurality extending perpendicularly from a second vertical axis parallel to the first-mentioned vertical axis but out of vertical alignment with the second vertical axis of the adjacent individual pluralities.

* * * * *